US007828490B2

(12) United States Patent
Nihashi et al.

(10) Patent No.: US 7,828,490 B2
(45) Date of Patent: Nov. 9, 2010

(54) PRINTING APPARATUS INCLUDING A COVER HOLDING A THERMAL HEAD AND A PLATEN ROLLER ON A HINGED FRAME

(75) Inventors: Kiyotaka Nihashi, Mishima (JP); Kenji Eoka, Sunto-gun (JP); Kousuke Takahashi, Sunto-gun (JP); Takeshi Hiyoshi, Mishima (JP); Tsuyoshi Sanada, Ang Mo Kio (SG); Akira Suzuki, Ang Mo Kio (SG)

(73) Assignees: Toshiba Tec Kabushiki Kaisha, Tokyo (JP); NCR Corporation, Dayton, OH (US)

( * ) Notice: Subject to any disclaimer, the term of this patent is extended or adjusted under 35 U.S.C. 154(b) by 492 days.

(21) Appl. No.: 11/681,907

(22) Filed: Mar. 5, 2007

(65) Prior Publication Data

US 2008/0003038 A1 Jan. 3, 2008

(30) Foreign Application Priority Data

May 31, 2006 (JP) ..... 2006-151693
Jun. 29, 2006 (JP) ..... 2006-178947
Jun. 29, 2006 (JP) ..... 2006-178953
Jun. 29, 2006 (JP) ..... 2006-178958

(51) Int. Cl.
*B41J 29/02* (2006.01)

(52) U.S. Cl. ..... 400/693; 400/120.01; 347/171; 347/222

(58) Field of Classification Search ..... None
See application file for complete search history.

(56) References Cited

U.S. PATENT DOCUMENTS 5,044,801 A * 9/1991 Uchimura et al. ..... 400/693
5,284,816 A * 2/1994 Stephenson ..... 503/227
5,961,228 A 10/1999 Ward et al.

(Continued)

FOREIGN PATENT DOCUMENTS

EP 1321304 6/2003

(Continued)

OTHER PUBLICATIONS

Japanese Office Action dated May 27, 2008 corresponding to U.S. Appl. No. 11/681,907, filed Mar. 5, 2007.

(Continued)

*Primary Examiner*—Jill E Culler
(74) *Attorney, Agent, or Firm*—Turocy & Watson, LLP

(57) ABSTRACT

A thermal printer has a main body, a cover body, a hinge mechanism, a first locating mechanism, and a second locating mechanism. At the time of a shift from a second state where the cover body is opened with respect to the main body to a first state where the cover body covers the main body, the first locating mechanism locates a first platen roller of the cover body with respect to a first thermal head of the main body, and arranges a second thermal head of the cover body in the vicinity of a second platen roller of the main body. The second locating mechanism locates the second thermal head arranged in the vicinity of the second platen roller by the first locating mechanism with respect to the second platen roller of the main body.

9 Claims, 11 Drawing Sheets

U.S. PATENT DOCUMENTS

| | | | | |
|---|---|---|---|---|
| 6,068,419 | A * | 5/2000 | Shiozaki et al. | 400/693 |
| 6,118,469 | A | 9/2000 | Hosomi | |
| 6,361,231 | B1 * | 3/2002 | Sato et al. | 400/120.16 |
| 6,388,692 | B1 * | 5/2002 | Iwata et al. | 347/212 |
| 6,406,200 | B2 * | 6/2002 | Mahoney | 400/120.16 |
| 6,565,273 | B2 * | 5/2003 | Yamada | 400/512 |
| 6,759,366 | B2 | 7/2004 | Beckerdite et al. | |
| 6,784,906 | B2 | 8/2004 | Long et al. | |

FOREIGN PATENT DOCUMENTS

| | | |
|---|---|---|
| EP | 1564014 | 8/2005 |
| JP | 58-008668 | 1/1983 |
| JP | 61-003765 | 1/1986 |
| JP | 62-286767 | 12/1987 |
| JP | 38552 | 1/1991 |
| JP | 03-051149 | 3/1991 |
| JP | 04-083675 | 3/1992 |
| JP | 05-28651 | 4/1993 |
| JP | 06-024082 | 2/1994 |
| JP | 06-155856 | 6/1994 |
| JP | 07-089140 | 4/1995 |
| JP | 09-174912 | 7/1997 |
| JP | 09-233256 | 9/1997 |
| JP | 10-076713 | 3/1998 |
| JP | 10-109456 | 4/1998 |
| JP | 10-235964 | 9/1998 |
| JP | 11-005320 | 1/1999 |
| JP | 11078153 | 3/1999 |
| JP | 11-286147 | 10/1999 |
| JP | 2000-118060 | 4/2000 |
| JP | 2000-203122 | 7/2000 |
| JP | 2001-071569 | 3/2001 |
| JP | 2001-199095 | 7/2001 |
| JP | 2001341371 | 12/2001 |
| JP | 2002-144611 | 5/2002 |
| JP | 2003-118153 | 4/2003 |
| JP | 2003-145854 | 5/2003 |
| JP | 2006-051734 | 2/2006 |
| WO | 2007102841 | 9/2007 |

OTHER PUBLICATIONS

Japanese Office Action dated May 7, 2008 corresponding to U.S. Appl. No. 11/681,907, filed Mar. 5, 2007.
Japanese Office Action dated May 8, 2008 corresponding to U.S. Appl. No. 11/681,907, filed Mar. 5, 2007.
European Search Report for 07109273.8—1251 dated Sep. 4, 2007.
Japanese Office Action mailed Oct. 21, 2008 corresponding to U.S. Appl. No. 11/681,907, filed on Mar. 5, 2007.
Japanese Office Action dated Jan. 5, 2010 corresponding to U.S. Appl. No. 11/681,907, filed Mar. 5, 2007.
European Search Report for 07 109 273.8 mailed January 27, 2010.
Japanese Office Action for 2006-178953 mailed on Aug. 17, 2010.

* cited by examiner

PRINTING APPARATUS INCLUDING A COVER HOLDING A THERMAL HEAD AND A PLATEN ROLLER ON A HINGED FRAME

CROSS-REFERENCE TO RELATED APPLICATIONS

This application is based upon and claims the benefit of priority from prior Japanese Patent Applications No. 2006-151693, filed May. 31, 2006; No. 2006-178947, filed Jun. 29, 2006; No. 2006-178953, filed Jun. 29, 2006; and No. 2006-178958, filed Jun. 29, 2006, the entire contents of all of which are incorporated herein by reference.

BACKGROUND OF THE INVENTION

1. Field of the Invention

The present invention relates to a printing apparatus capable of printing on both faces of roll paper.

2. Description of the Related Art

For example, both side printing mechanisms capable of printing simultaneously on both faces of thermal recording paper are known. In the both side printing mechanisms, a first printing section having a first thermal head and a first platen roller across a paper feed path, and a second printing section having a second thermal head and a second platen roller across the paper feed path are arranged symmetrically.

In the both side printing mechanisms, the first thermal head executes printing on a front face of thermal recording paper passing through the paper feed path, and the second thermal head executes printing on a rear face of the thermal recording paper, so that a printing process can be executed on both faces of the thermal recording paper (for example, see Jpn. Pat. Appln. KOKAI Publication No. 11-286147).

In such a kind of printing apparatuses, a first printing section is arranged on a downstream side of a paper feed direction, and a second printing section is arranged on an upstream side of the paper feed direction in a paper feed path. The first and second printing sections execute printing simultaneously on both faces of paper.

The first printing section has a first thermal head as a printing head, and a first platen roller which is arranged to be opposed to the first thermal head via the paper feed path and feeds paper. The second printing head has a second thermal head as a printing head, and a second platen roller which is arranged to be opposed to the second thermal head via the paper feed path and transports the paper. The first and second thermal heads, and the first and second platen rollers are positioned on opposite sides of the paper feed path, respectively, so that the printing can be executed simultaneously on both faces of paper (for example, see U.S. Pat. No. 6,784,906).

It is considered that the similar constitution to that of the both side printing mechanisms is applied to thermal printers having an upper frame capable of being opened/closed with respect to a main body. In such thermal printers, for example, the main body includes only a first platen roller and a second thermal head. The upper frame is disposed with a first thermal head and a second platen roller, for example. When the thermal heads and the platen rollers are arranged in separated members, it is necessary to locate the thermal heads and the platen rollers. For this reason, the second thermal head of the cover body is located on the second platen roller of the main body, and the first platen roller of the cover body is located on the first thermal head of the main body by using an operation for bringing an opened state of the cover body into a closed state.

In the thermal printers having the above constitution, the thermal heads and the corresponding platen rollers are separately arranged in the upper frame and the main body, respectively. Thus, when they are arranged in desired positions, they should be located with high accuracy. For this reason, the management of the position accuracy takes efforts and is expensive, and the entire thermal printer needs high production cost.

Paper is of a roll type, and is mounted into the apparatus main body and is pulled out to be set across the first and second printing sections for use. When the paper is used up, the paper should be replaced with new one, in which case an open/close member on the upper face side of the apparatus main body is opened so that the paper is replaced with new one.

Since the open/close member is, however, opened manually by an operator totally, this operation takes efforts.

The printing is not always executed on both faces of thermal recording paper, and occasionally the printing is executed on only one face. However, since the thermal heads always touch thermal recording paper, the thermal heads abrade away due to friction with thermal recording paper, and thus thermal recording paper should be frequently replaced. Since useless load is applied to the mechanism of a driving system, malfunction easily occurs.

Since the thermal heads are expensive parts in parts composing a printer, both side printing thermal printers become more expensive than one side printing thermal printers. For this reason, when users, who need only the one side printing at the present moment but possibly needs the both side printing later, purchase the both side printing thermal printers at first, the initial introduction cost becomes high. On the other hand, when the one side printing thermal printer is purchased at first and the both side printing thermal printer is purchased at the time of the both side printing, it is uneconomical because the transport mechanism and the like can be shared.

BRIEF SUMMARY OF THE INVENTION

It is an object of the present invention to provide a thermal printer which is capable of improving position accuracy of thermal heads with respect to platen rollers in a simple constitution.

A printing apparatus of the present invention comprises: a main body having a first thermal head capable of printing on a first face of roll paper; a cover body having a second thermal head capable of printing on a second face opposite to the first face of the roll paper; a hinge mechanism which retains the cover body so that the cover body can rotationally move between a first state that it covers the main body and a second state that it is opened with respect to the main body; a first platen roller provided to the cover body so as to correspond to the first thermal head of the main body; a second platen roller provided to the main body so as to correspond to the second thermal head of the cover body; a first locating mechanism which locates the first platen roller of the cover body with respect to the first thermal head of the main body when the cover body makes the shift from the second state to the first state, and arranges the second thermal head of the cover body in the vicinity of the second platen roller of the main body; and a second locating mechanism which locates the second thermal head arranged in the vicinity of the second platen roller by the first locating mechanism with respect to the second platen roller of the main body.

It is another object of the present invention to open an open/close member by one operation without requiring a special operation.

Another printing apparatus of the present invention comprises: an apparatus main body having a rotatable open/close member; a first printing head and a first platen roller which are arranged so as to be opposed to each other via a paper transfer path and execute printing on a first face of paper, and a second printing head and a second platen roller which execute printing on the other face of the paper in the apparatus main body; first and second spring materials which are compressed based on a blocking operation of the open/close member so as to elastically press the first and second printing heads against the first and second platen rollers; lock means for locking the open/close member to a blocking position; lock releasing means for releasing the locking of the lock means; a spring material for opening which opens the open/close member by means of a spring force based on the lock releasing of the lock means by means of the lock releasing means; and decelerating means for reducing an opening speed of the open/close member released by the spring material for opening.

It is still another object of the present invention to reduce abrasion of the thermal heads and a load on a mechanism and heighten reliability.

Still another printing apparatus of the present invention comprises: a thermal recording paper supply mechanism which supplies thermal recording paper along a paper feed path; a first thermal head which is provided along the paper feed path and is arranged to be opposed to a first face of the paper feed path; a first platen roller which is arranged with respect to the first thermal head via the paper feed path; a second thermal head which is provided along the paper feed path and is arranged to be opposed to a second face of the paper feed path; a second platen roller which is arranged with respect to the second thermal head via the paper feed path; and a both side printing thermal printer which has an actuator for separating at least one of the first thermal head and the second thermal head from the paper feed path.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

First Embodiment

Figure 1:
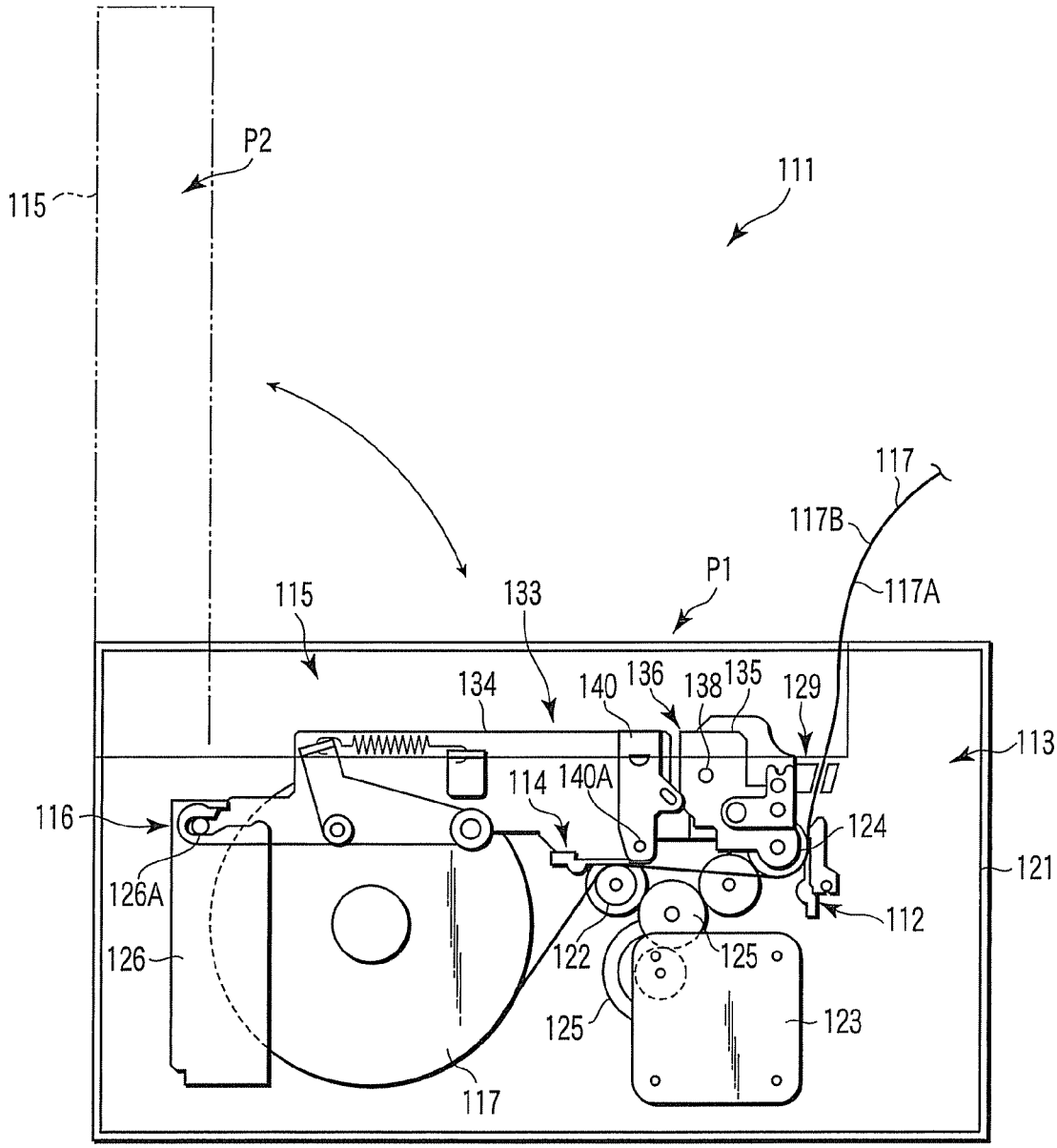
FIG. 1 is a side view illustrating a thermal printer according to a first embodiment of the present invention.

As shown in FIG. 1, a thermal printer 111 has a main body 113 having a first thermal head 112, a cover body 115 having a second thermal head 114, and a hinge mechanism 116 provided between the main body 113 and the cover body 115. The hinge mechanism 116 supports the cover body 115 so that the cover body 115 rotationally moves between a first state P1 where the cover body 115 covers the main body 113 and a second state P2 where the cover body 115 is opened with respect to the main body 113.

Figure 2:
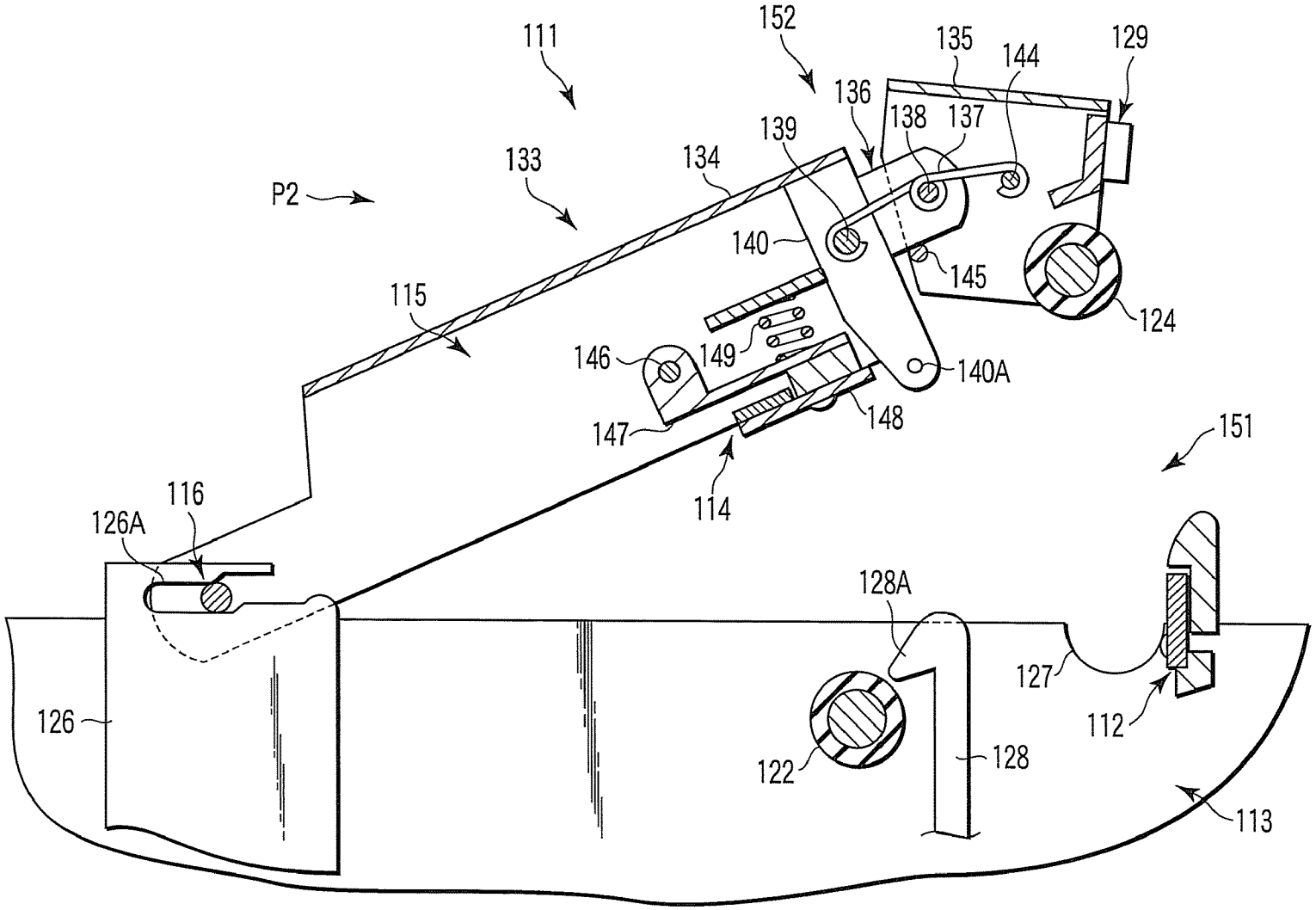
FIG. 2 is a sectional view illustrating a state that an upper frame lifts in the thermal printer shown in FIG. 1.

As shown in FIGS. 1 and 2, the main body 113 has an enclosure 121 which can enclose roll paper 117 therein, the first thermal head 112 which can execute printing on a first face 117A of the roll paper 117, a second platen roller 122 which is supported rotatably to the enclosure 121 so as to correspond to the second thermal head 114 of the cover body 115, a driving section 123 which drives feeding of the roll paper 117, a reduction gear 125 which transmits a driving force of the driving section 123 to a first platen roller 124 and the second platen roller 122, a main body frame 126 which supports the hinge mechanism 116, a concave section 127 into which the first platen roller 124 is fitted when the cover body 115 is in the first state P1, a hook member 128 which is hooked with the cover body 115, and a part of a cutter mechanism 129.

The roll paper 117 is made of, for example, both side thermal recording paper. The roll paper 117 is fitted into a recessed portion, not shown, in the enclosure 121 so as to be rotatably supported. The second platen roller 122 is supported rotatably to the enclosure 121 by a center impeller, for example. The driving section 123 is composed of a stepping motor, for example. The concave section 127 has a semicircle shape where its upper portion is opened. That is to say, the concave section 127 has a shape which is complementary with respect to the first platen roller 124 having a pillar shape.

The hook member 128 can move rotationally about a shaft, not shown, provided to a lower end, for example. The hook member 128 has, for example, a torsion coil spring which is set between the hook member 128 and the enclosure 121. When a force is applied to the hook member 128 to a direction of separating from the second platen roller 122, a force is applied to the hook member 128 to a direction approaching the second platen roller 122 by counteraction of the torsion coil spring.

The first thermal head 112 is arranged on a downstream side in a feeding direction of the roll paper 117 from the second platen roller 122. The first thermal head 112 is pushed towards the first platen roller 124 by a compression spring, not shown. The main body frame 126 has a long hole 126A along which the hinge mechanism 116 can slide in a horizontal direction.

The cover body 115 has an upper frame 133, the second thermal head 114 for printing on a second face 117B opposite to the first face 117A of the roll paper 117, the first platen roller 124 which is rotatably supported to the upper frame 133 so as to correspond to the first thermal head 112, an outlet, not shown, for discharging the roll paper 117 to the outside, and a part of the cutter mechanism 129 which is arranged so as to be adjacent to the lower stream of the first platen roller 124. The first thermal head 112 is attached to the upper frame 133. The second platen roller 122 is rotatably supported to the upper frame 133 by a center impeller. The first thermal head 112 is arranged on the lower stream side in the feeding direction of the roll paper 117 with respect to the second platen roller 122.

As shown in FIGS. 1 and 2, the upper frame 133 has a first frame 134 fixed to the hinge mechanism 116, a second frame 135 separated from the first frame 134, a connector 136 which connects the first frame 134 and the second frame 135 so that the second frame 135 can move rotationally with respect to the first frame 134, and a torsion coil spring 137 which is set between the first frame 134 and the second frame 135. A shaft section 138 around which the torsion coil spring 137 is wound is provided to the connector 136. The shaft section 138 functions as the center of the rotational movement of the second frame 135. The first frame 134 has a first pin 139 around which one end of the torsion coil spring 137 is wound, and an arm member 140 including an engagement pin 140A engaged with the hook member 128. The engagement pin 140A of the arm member 140 is arranged in the vicinity of the connector 136.

The second thermal head 114 is rotatably retained in the first frame 134. The first platen roller 124 is rotatably retained in the second frame 135, and the second frame 135 is provided with a part of the cutter mechanism 129.

The second frame 135 has a second pin 145 around which the other end of the torsion coil spring 137 is wound, and a regulating pin 145 which regulates the rotational moving range of the second frame 135. The second frame 135 can rotationally move about the shaft section 138 of the connector 136 with respect to the first frame 134. The second frame 135 is pushed to the direction of the main body 113 by the force of the torsion coil spring 137. In this state, the connector 136 butts against the regulating pin 145 so that the second frame 135 does not rotationally move toward the main body 113 any more.

As shown in FIG. 2, the second thermal head 114 has a head main body 148, a head frame 147 which supports the head main body 148 and can rotationally move about a pivot 146, and a compression spring 149 which pushes the head main body 148 against the second platen roller 122 of the main body 113.

A printing operation of the thermal printer 111 is simply explained with reference to FIG. 1. In the thermal printer 111 of this embodiment, the driving section 123 drives so as to rotate the reduction gear 125 an to rotate the first platen roller 124 and the second platen roller 122. The roll paper 117 is sent toward the outlet by a frictional force generated between the first platen roller 124, the second platen roller 122 and the roll paper 117 due to the rotations of the first platen roller 124 and the second platen roller 122. The second thermal head 114 executes the printing process on the second face 117B of the roll paper 117. The first thermal head 112, then, executes the printing process on the first face 117A of the roll paper 117. The cutter mechanism 129 finally cuts the roll paper 117 into strip-shaped sheets, and the printing process of the thermal printer 111 is ended.

As shown in FIG. 2, the thermal printer 111 has a first locating mechanism 151 and a second locating mechanism 152 which locate the first platen roller 124 of the cover body 115 with respect to the first thermal head 112 of the main body 113, and locate the second thermal head 114 of the cover body 115 with respect to the second platen roller 122 of the main body 113. The first locating mechanism 151 includes the concave section 127 and the like of the main body 113. The second locating mechanism 152 includes the first platen roller 124 which is fitted into the concave section 127, the first frame 134, the second frame 135, the hook member 128 and the like.

The functions of the first locating mechanism 151 and the second locating mechanism 152 are explained below with reference to FIGS. 2 to 5.

FIG. 2 illustrates the second state P2 where the cover body 115 is opened with respect to the main body 113. As shown in FIG. 2, the upper frame 133 is in a state that it is separated from the main body 113. In this state, the first frame 134 is pushed downward by the torsion coil spring 137. In this state, the connector 136 of the first frame 134 butts against the regulating pin 145 of the second frame 135, so that the rotational moving range of the second frame 135 is regulated.

Figure 3:
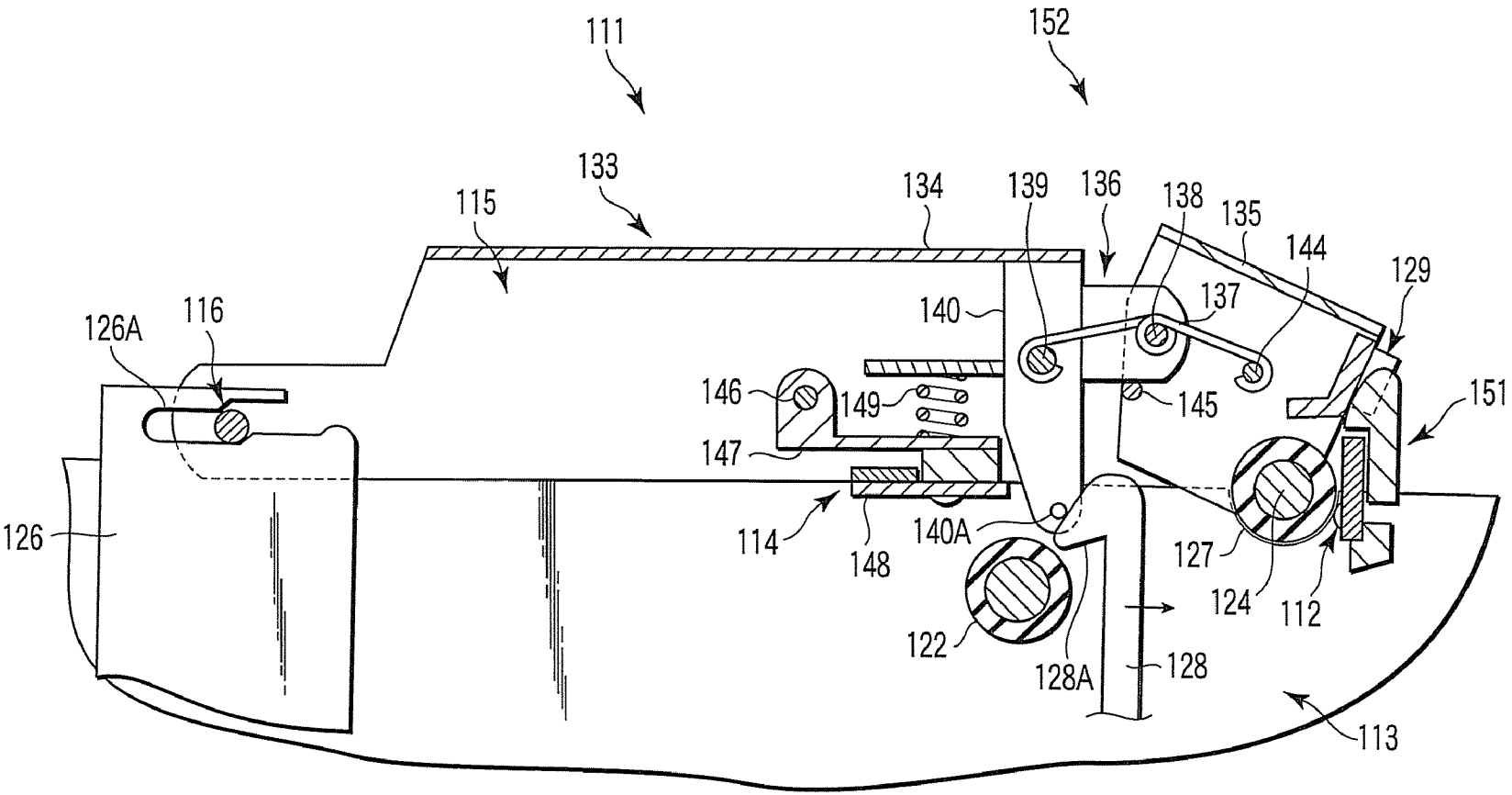
FIG. 3 is a sectional view illustrating a state that a first platen roller of the upper frame shown in FIG. 2 is fitted into a concave section as a first locating mechanism.

As shown in FIG. 3, when a user closes the cover body 115 so that the cover body 115 is brought from the second state P2 into the first state P1, the first platen roller 124 is fitted into the concave section 127 as the first locating mechanism 151. The first locating mechanism 151 can locate the first platen roller 124 on the first thermal head 112. When the first platen roller 124 is fitted into the concave section 127, the second thermal head 114 is arranged in the vicinity of the second platen roller 122, so that the second thermal head 114 is roughly located. In the state shown in FIG. 3, the engagement pin 140A of the second frame 135 butts against a clasp section 128A of the hook member 128 so as to push the hook member 128 to a direction where it is separated from the second platen roller 122.

Figure 4:
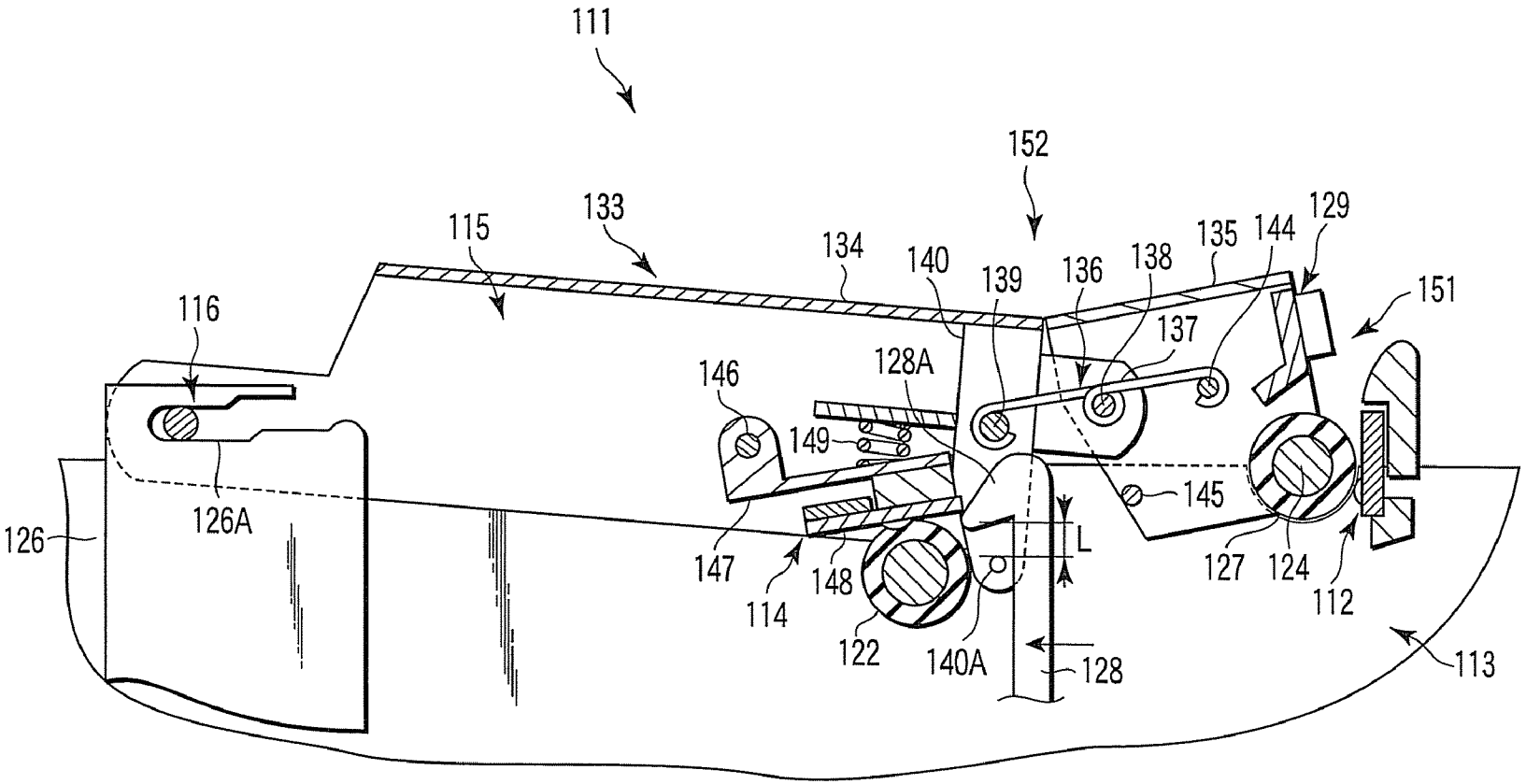
FIG. 4 is a sectional view illustrating a state that the upper frame shown in FIG. 3 is bent reversely so that a connector approaches a main body.

As shown in FIG. 4, when the user continues the pushing of the cover body 115, the first frame 134 and the second frame 135 of the upper frame 133 are brought into a so-called reverse bent state. During the process from the state of FIG. 3 to the reversely bent state of FIG. 4, the first platen roller 124 which is fitted into the concave section 127 included in the second locating mechanism 152 functions as a supporting point. That is to say, since the second frame 135 can rotationally move with respect to the first platen roller 124, the connector 136 can be rotationally move about the first platen roller 124 so as to approach the main body 113. Simultaneously with the rotational movement of the second frame 135, the first frame 134 also rotationally moves. The connector 136 is made to close to the main body 113 by the rotational movement of the first frame 134 and the second frame 135. When the connector 136 approaches the main body 113, the engagement pin 140A of the arm member 140 passes the clasp section 128A of the hook member 128, and the hook member 128 moves to approach the second platen roller 122. In this case, an overlap L having a predetermined length is generated between the engagement pin 140A of the arm member 140 and the lower end of the clasp section 128A of the hook member 128.

The second thermal head 114 is pushed against the second platen roller 122. In the second thermal head 114, the head frame 147 rotationally moves about the pivot 146. The compression spring 149 is compressed by the rotational movement of the head frame 147, and the head main body 148 is pushed against the second platen roller 122 by counteraction of the compression spring 149.

Figure 5:
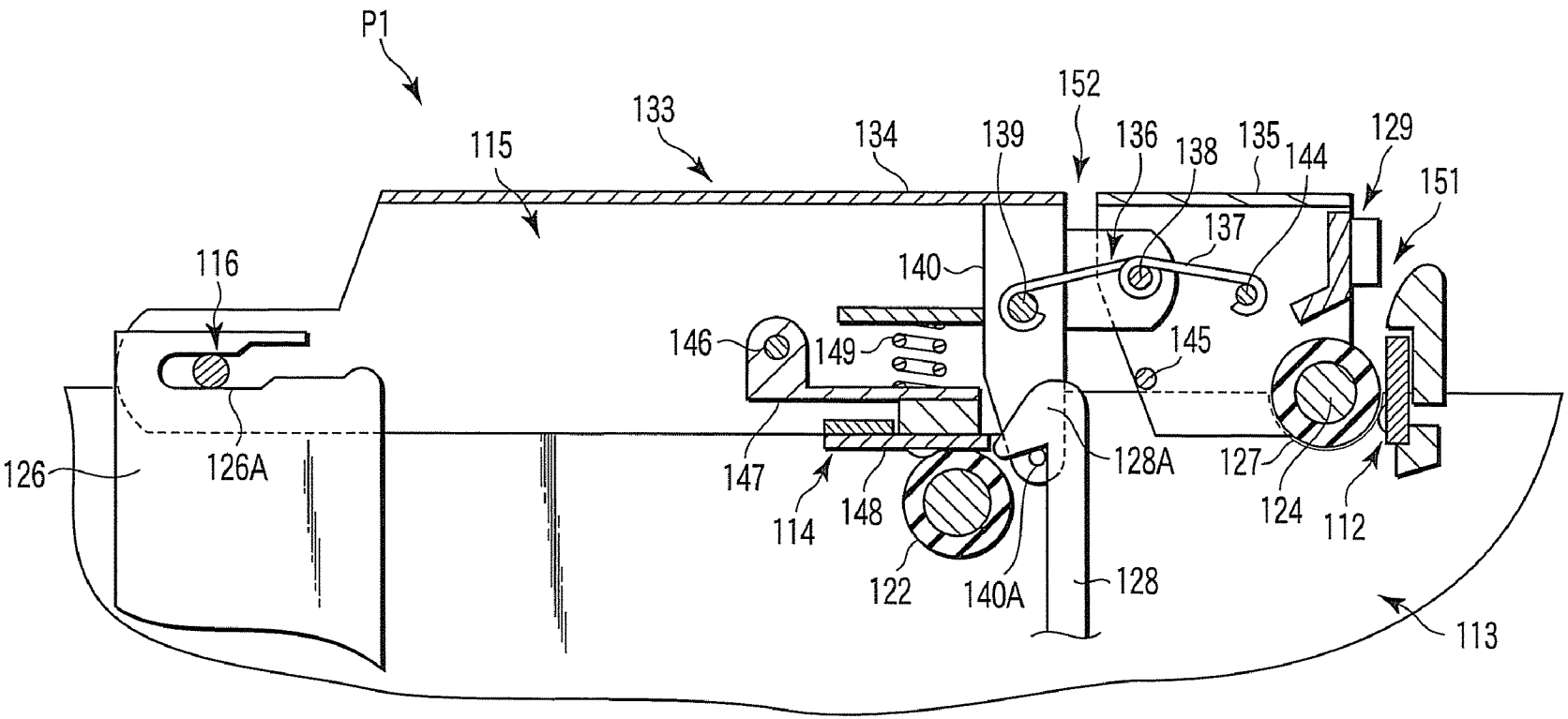
FIG. 5 is a sectional view illustrating a state that the upper frame shown in FIG. 4 is fixed completely to the main body.

As shown in FIG. 5, when the user releases the pushing of the cover body 115, the upper frame 133 recovers from the reversely bent state, and the first frame 134 and the second frame 135 are brought into a horizontal state. In this state, the hook member 128 as the second locating mechanism 152 is hooked on the engagement pin 140A of the arm member 140. As a result, a vertical position of the second thermal head 114 is determined. When the upper frame 133 is in the horizontal state, the state that the first platen roller 124 is fitted into the concave section 127 of the first locating mechanism 151 is maintained. The concave section 127 of the first locating mechanism 151 determines a horizontal position of the second thermal head 114. The cover body 115 is brought into the first state P1 where it covers the main body 113 through such a process. The first locating mechanism 151 and the second locating mechanism 152 can locate the first platen roller 124 and the second thermal head 114.

The above explains the thermal printer 111 according to this embodiment. According to this embodiment, since the second locating mechanism 152 as well as the first locating mechanism 151 is provided, the first thermal head 112 and the second thermal head 114 can be located accurately. Particularly, the second thermal head 114 is arranged in the vicinity of the second platen roller 122 by the first locating mechanism 151 in advance and then is located on the second platen roller 122 by the second locating mechanism 152. For this reason, the second thermal head 114 and the second platen roller 122 which are far from each other can be located more accurately than the case where they are located by a single locating mechanism at one time.

The cover body 115 has the first frame 134 which supports the second thermal head 114, the second frame 135 which supports the first platen roller 124, and the connector 136 which connects the first frame 134 and the second frame 135 so that the second frame 135 can rotationally move with respect to the first frame 134. As a result, the divided type upper frame 133 in which the second frame 135 can be rotationally moved with respect to the first frame 134 can be constituted.

The first locating mechanism 151 includes the concave section 127, and the concave section 127 locates the first platen roller 124 which is fitted thereinto with respect to the first thermal head 112, and determines the horizontal position of the second thermal head 114 with respect to the first platen roller 124 via the locating of the first platen roller 124. As a result, the position of the first platen roller 124 and the horizontal position of the second thermal head 114 can be determined collectively.

The second locating mechanism 152 includes the first platen roller 124 which is fitted into the concave section 127, the first frame 134 and the second frame 135. When the second locating mechanism 152 rotationally moves the first frame 134 and the second frame 135 about the first platen roller 124 fitted into the concave section 127 so that the connector 136 is made to be close to the main body 113, so as to locate the second thermal head 114 of the cover body 115 with respect to the second platen roller 122 of the main body 113. As a result, since the second thermal head 114 can be located with the first platen roller 124 fitted into the concave section 127 of the main body 113 being used as the supporting point, the second thermal head 114 can be located more accurately. Since the second thermal head 114 is located by using the rotational movements of the first frame 134 and the second frame 135 in the state that the first platen roller 124 is fixed, the second thermal head 114 can be made to be closer gradually to the second platen roller 122 of the main body 113. As a result, when the second thermal head 114 is located, the second thermal head 114 is prevented from swiftly butting against the second platen roller 122, thereby preventing a situation such that the second thermal head 114 is displaced due to an impact at the time of butting against the second platen roller 122.

The second locating mechanism 152 includes the hook member 128 which is provided to the main body 113 so as to be hooked on the cover body 115 in the first state P1. The hook member 128 determines the vertical position of the second thermal head 114 with respect to the second platen roller 122. For this reason, the second locating mechanism 152 can determine the horizontal position and the vertical position of the second thermal head 114 in cooperation with the first locating mechanism 151.

The hook member 128 is engaged with the arm member 140 positioned in the vicinity of the connector 136 between the first frame 134 and the second frame 135. For this reason, the hook member 128 can be engaged with the connector 136 whose moving distance is the longest, and the overlap L between the hook member 128 and the arm member 140 can be sufficiently provided. When the overlap L between the hook member 128 and the arm member 140 can be sufficiently provided, the engagement pin 140A does not disengage from the hook member 128, and the cover body 115 can be fixed to the main body 113 securely.

The hook member 128 engages with the arm member 140 of the first frame 134 in the upper frame 133. In the thermal printer 111 of this embodiment, therefore, the first platen roller 124 of the first frame 134 is fixed by the concave section 127 of the main body 113, and the second frame 135 is fixed by the hook member 128. For this reason, fixing means for the main body 113 can be arranged on both the first frame 134 and the second frame 135, respectively, thereby holding the upper frame 133 to the main body 113 stably.

The concave section 127 has a semicircular shape whose upper portion is opened. For this reason, the first locating mechanism 151 can be constituted by the simple structure. The semicircular concave section 127 determines the horizontal position and the vertical position of the first platen roller 124 simply and accurately. The semicircular concave section 127 can determine also the horizontal position of the second thermal head 114 accurately.

Second Embodiment

Figure 6:
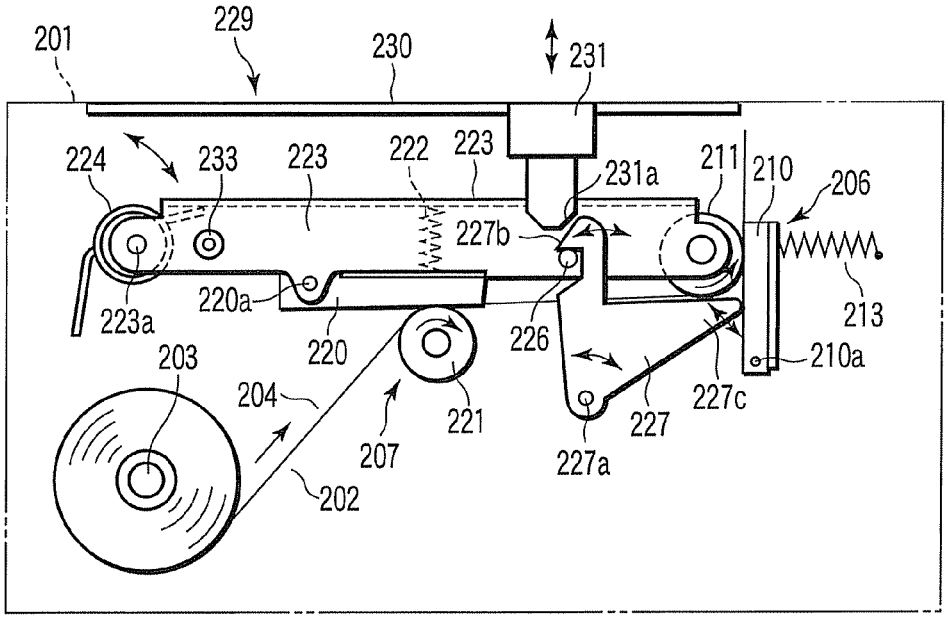
FIG. 6 is a schematic constitutional diagram illustrating a printing apparatus according to a second embodiment of the present invention.

FIG. 6 illustrates a printing apparatus according to a second embodiment of the present invention. 201 in the drawing designates an apparatus main body, and a reel section 203 which supplies paper 202 is provided in the apparatus main body 201. Both faces of the paper 202 are thermal printing faces, and the paper 202 is pulled out along a paper feed path 204.

First and second printing sections 206 and 207 are disposed in the paper feed path 204. The first printing section 206 is positioned on a lower stream side of a feed direction of the paper 202, and the second printing section 207 is positioned on an upper stream side of a feed direction of the paper 202.

The first printing section 206 has a first thermal head 210 as a first printing head, and a first platen roller 211 is disposed so as to be opposed to the first thermal head 210 via the paper feed path 204. A lower side of the first thermal head 210 is rotatably supported to a main body frame side via a pivot 210*a*, and its upper side is elastically pressurized by a first spring 213 as a first spring material so that its heat generating face is made to pressure-contact with the first platen roller 211. The first platen roller 211 is driven to be rotated by a driving mechanism, not shown, and transports the paper 202.

The second printing section 207 has a second thermal head 220 as a second printing head, and a second platen roller 221 is arranged so as to be opposed to the second thermal head 220 via the paper feed path 204. The second platen roller 221 is rotatably mounted to the main body frame side, and is driven to be rotated by a driving mechanism, not shown, so as to transport the paper 202.

The second thermal head 220 is rotatably mounted to a center on the lower side of the upper frame 223 via a pivot 220*a*. The second thermal head 220 is elastically pressurized downward by a second spring 222 as a second spring material, and its heat generating face is made to pressure-contact with the second platen roller 221.

One end of the upper frame 223 is rotatably supported to the main body frame via a pivot 223*a*, and the first platen roller 211 is rotatably mounted to a rotational moving end of the upper frame 223.

That is to say, the first platen roller 211 and the second thermal head 220 are mounted to the upper frame 223, and the first thermal head 210 and the second platen roller 221 are mounted to the main body frame.

A toggle spring 224 as a spring material for opening is provided to one end of the upper frame 223, and the upper frame 223 is rotationally moved up so as to be opened by a spring force of the toggle spring 224.

A latch pin 226 as a latch member is projected from a side face of the upper frame 223, and the latch pin 226 is latched on a hook lever 227 as a hook member detachably. The latch pin 226 and the hook lever 227 compose locking means. A lower side of the hook lever 227 is mounted so as to rotationally move via the pivot 227*a*, and a cam section 227*c* which touches the first thermal head 210 is formed integrally with a part of the hook lever 227.

On the other hand, an upper face cover 230 is provide to an upper face of the apparatus main body 201 so as to freely open and close, and the upper face cover 230 and the upper frame 223 compose an open/close member 229. The upper face cover 230 is provided coaxially with the upper frame 223, and is opened and closed integrally with the upper frame 223.

An operation button 231 as lock releasing means is provided to the upper face cover 230, and a taper surface 231*a* is formed on a lower end of the operation button 231. A taper surface 227*b* which is opposed to the taper surface 231*a* of the operation button 231 is formed on an upper end of the hook lever 227.

When the operation button 231 is pressed down in the state that the upper face cover 230 is closed, its taper surface 231*a* is pushed against the taper surface 227*b* of the hook lever 227 so that the hook lever 227 is rotationally moved to a clockwise direction and its latching on the latch pin 226 is released. The cam section 227*c* pushes the first thermal head 210 and the first thermal head 210 is separated from the platen roller 211.

Figure 7:
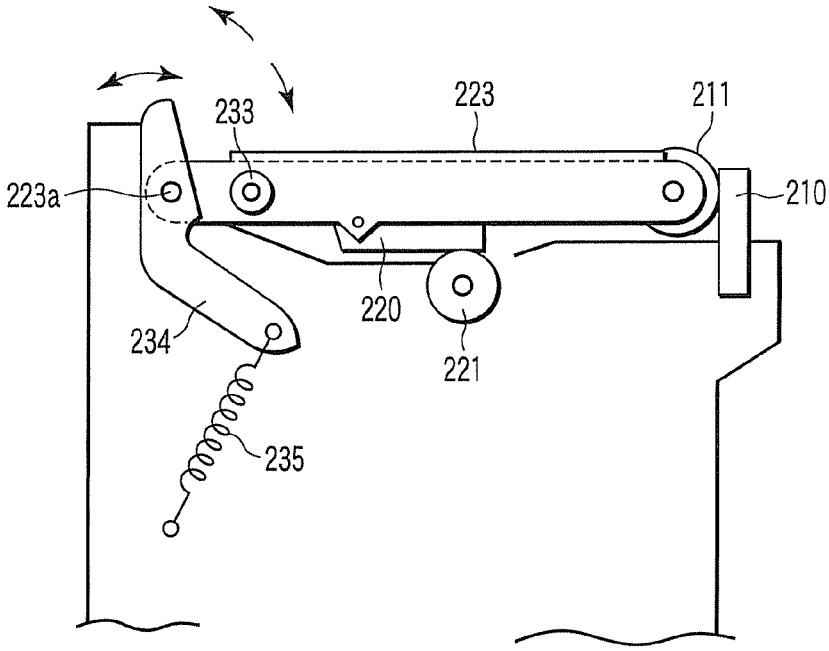
FIG. 7 is a diagram illustrating a decelerating mechanism for decreasing an opening speed of an open/close cover in the printing apparatus of FIG. 6.

A rotational moving lever 234 composing decelerating means is provided coaxially with the pivot 223*a* of the upper frame 223 as shown in FIG. 7. A spring 235 as a load applying member for biasing the rotationally moving lever 234 to a counterclockwise direction is connected to a lower side of the rotationally moving lever 234.

A projection 233 made of rubber (NBR) is projected from a side face of the upper frame 223, and the projection 233 touches the rotationally moving lever 234 at the time when the upper frame 223 is opened.

The printing operation of the printing apparatus having the above constitution is explained below. As shown in FIG. 6, in the state that the paper 202 is set between the first printing section 206 and the second printing section 207, the first and second platen rollers 211 and 221 are rotationally driven to a direction of an arrow shown in the drawing by a driving mechanism, not shown. As a result, the paper 202 is fed to the direction of the arrow in the drawing and information is printed on one face of the paper 202 by the first thermal head 210, and simultaneously information is printed on the other face of the paper 202 by the second thermal head 202.

When the paper 202 is used up for the printing, the paper 202 should be replaced by new one.

The replacing operation of the paper 202 is explained below. In this case, the operation button 231 is first pushed down. As a result, the taper surface 227*b* on the upper side of the hook lever 227 is pushed by the taper surface 231*a* on the lower side of the operation button 231 so that the hook lever 227 is rotated to the clockwise direction about the pivot 227*a*. The hook lever 227 is unlatched from the latch pin 226 by this rotation, and the first thermal head 210 is pushed by the cam section 227*c* to be rotationally moved to the clockwise direction about the pivot 210*a* against the biasing force of the first spring 213 and be separated from the first platen roller 211. Due to the release of the locking, the upper frame 223 is rotationally moved slightly upward about the pivot 223*a* by the repulsive force of the second spring 222. Thereafter, the upper frame 223 is further rotationally moved upward by the spring force of the toggle spring 224, and the upper frame 223 as well as the upper face cover 230 is opened into an uprise state.

Figure 8:
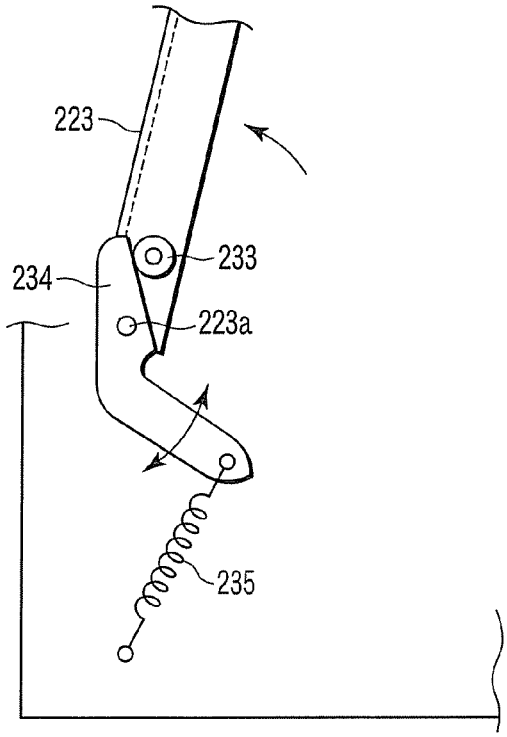
FIG. 8 is a diagram illustrating an operating state of the decelerating mechanism in FIG. 7.

In the state that the upper frame 223 is opened, the projection 233 of the upper frame 223 touches the upper side of the rotationally moving lever 234 as shown in FIG. 8. As a result, the rotationally moving lever 234 rotationally moves to the clockwise direction about the pivot 234*a*. At this time, however, the biasing force of the spring 235 as a rotationally moving load acts on the rotationally moving lever 234, and momentum at the time when the upper frame 223 is opened is reduced into a suitable speed so that the upper frame 223 as well as the upper face cover 230 is opened. After the opening, new paper is replenished so that the replacement of paper is finished.

According to this embodiment, only by releasing the latching between the latch pin 226 and the hook lever 227 by pressing down the operation button 231, the upper frame 223 and the upper face cover 230 can be opened. The operator may, therefore, simply press down the operation button 231, and thus the opening operation of the upper frame 223 and the upper face cover 230 becomes easy.

When the upper frame 223 is opened, the projection 233 of the upper frame 223 is made to touch the rotationally moving lever 234 so that the rotationally moving lever 234 is rotationally moved against the biasing force of the spring 235. For this reason, when the upper frame 223 is opened, the opening speed of the upper frame 223 is reduced by the biasing force of the spring 235, and thus it can be opened safely.

When the upper frame 223 is opened, the first thermal head 210 is rotationally moved by the cam section 227*c* of the hook lever 227 against the biasing force of the first spring 213 so as to be separated from the first platen roller 211. For this reason, a contact pressure between the first thermal head 210 and the first platen roller 211 does not become an opening load, thereby enabling smooth opening.

Third Embodiment

Figure 10:
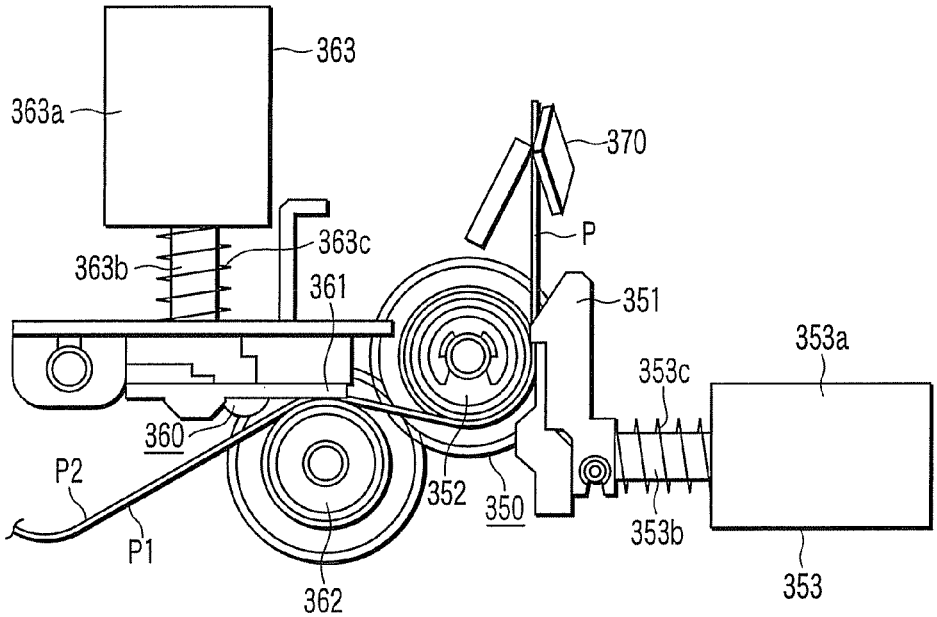
FIG. 10 is a side view illustrating a main section of a printing mechanism incorporated into the both side printing thermal printer.
Figure 9:
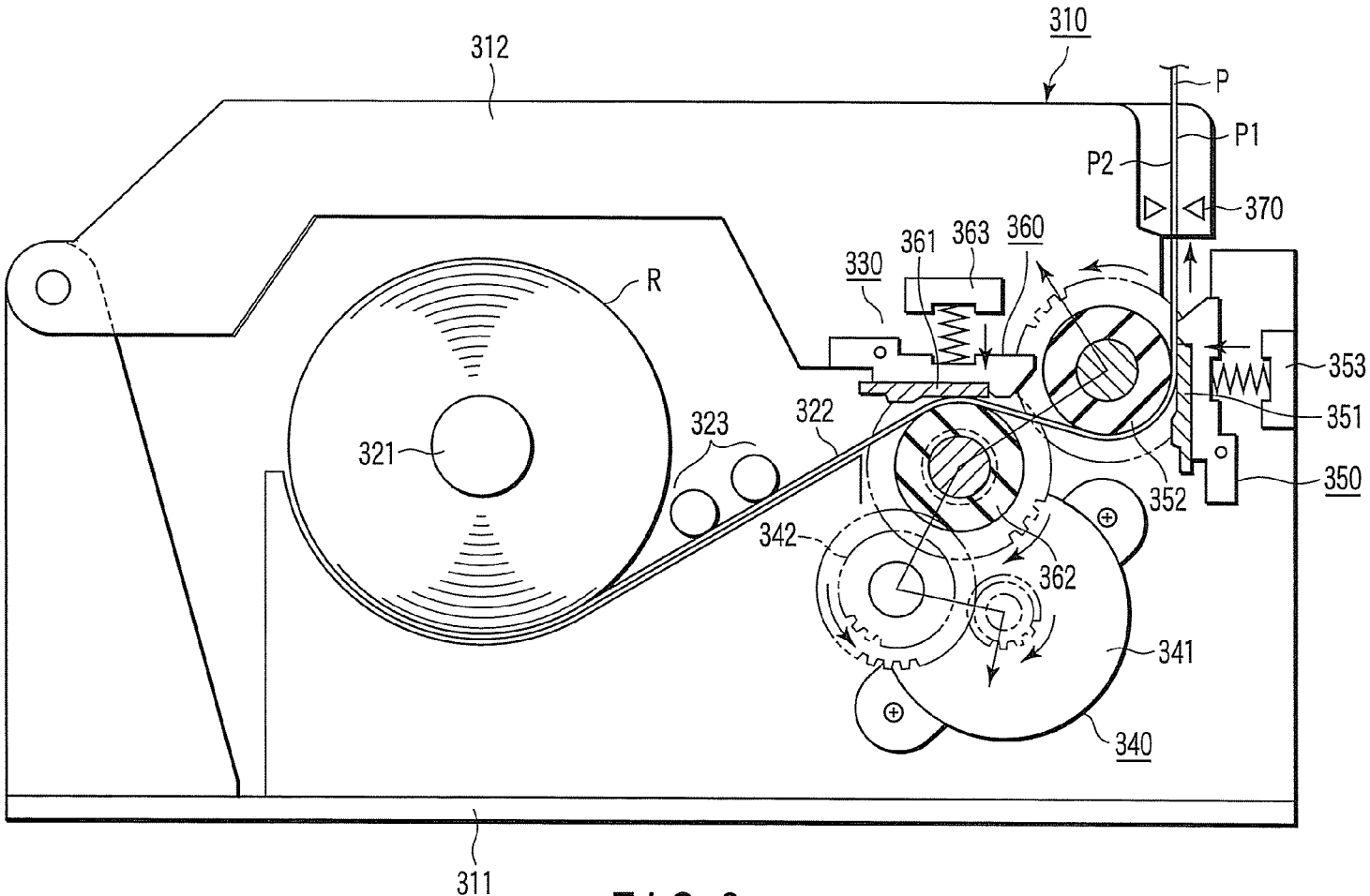
FIG. 9 is a vertical sectional view schematically illustrating a both side printing thermal printer according to a third embodiment of the present invention.

FIG. 9 is a vertical sectional view schematically illustrating a both side printing thermal printer 310 according to a third embodiment of the present invention, and FIG. 10 is a side view illustrating a main section of a printing mechanism 330 incorporated into the both side printing thermal printer 310. In FIG. 9, P designates thermal recording paper having both printing faces.

The both side printing thermal printer 310 has an enclosure 311, an enclosure main body 312 for housing respective mechanisms, and an open/close cover 313 which is provided to the enclosure main body 312 so as to be opened/closed freely.

The enclosure 311 houses a thermal recording paper supply section 320 which rotatably supports a thermal recording paper roll R around which the thermal recording paper P is wound and supplies the thermal recording paper P, and a printing mechanism 330 which executes printing on the supplied thermal recording paper P.

The thermal recording paper supply section 320 has a retainer 321 which retains the thermal recording paper roll R, and a feed mechanism 323 which feeds the thermal recording paper P from the retainer 321 to the printing mechanism 330 along a paper feed path 322.

The printing mechanism 330 has a driving mechanism 340, a first printing section 350 provided along the paper feed path 322, a second printing section 360, and a cutting mechanism 370.

The driving mechanism 340 has a driving motor 341, and a gear mechanism 342 which transmits a rotational force generated by the driving motor 341 to the respective sections.

The first printing section 350 has a first thermal head 351 which is arranged on one side (first face side) perpendicular to a projecting direction of the paper feed path 322 in an opposed manner, a first platen roller 352 which is arranged so as to be opposed to the first thermal head 351 via the paper feed path 322, and a first actuator 353 which advances and retreats the first thermal head 351 towards the first platen roller 352. The first platen roller 352 is driven by a gear mechanism 342. The first actuator 353 has a driving section 353*a* composed of a solenoid or a stepping motor, a rod 353*b* which is operated by the driving section 353*a*, and a spring 353*c* which biases the rod 353*b* towards the first platen roller 352.

The second printing section 360 has a second thermal head 361 which is arranged on the other side (second face side) perpendicular to the projecting direction of the paper feed path 322 in an opposed manner, a second platen roller 362 which is arranged so as to be opposed to the second thermal head 361 via the paper feed path 322, and a second actuator 363 which advances and retreats the second thermal head 361 towards the second platen roller 362. The second platen roller 362 is driven by the gear mechanism 342. The second actuator 363 has a driving section 363*a* composed of a solenoid or a stepping motor, a rod 363*b* which is operated by the driving section 363*a*, and a spring 363*c* which biases the rod 363*b* towards the second platen roller 362.

The both side printing thermal printer 310 having such a constitution executes the printing as follows. When electrical connection to the first actuator 353 and to the second actuator 363 is cut in advance, the projecting amount of the rods 353*b* and 363*b* becomes maximum due to the function of the springs 353*c* and 363*c*. As a result, the first thermal head 351 and the second thermal head 361 are pressurized to the first platen roller 352 and the second platen roller 362, respectively.

When a printing command is inputted from the outside, the driving motor 341 rotates to a constant direction. The rotation of the driving motor 341 drives the feed mechanism 323 via the gear mechanism 342, and supplies the thermal recording paper P to the second printing section 360. The second printing section 360 starts the printing on the second face P2 of the thermal recording paper P. When the thermal recording paper P reaches the first printing section 350, the printing on the first face P1 of the thermal recording paper P is started.

When the printing on both the faces of the thermal recording paper P is completed, the feed mechanism 323 sends the thermal recording paper P to the cutting mechanism 370, and the paper is cut.

The case where the printing is executed on only one face is explained below. For example, when the printing is executed on the first face P1 of the thermal recording paper P, the second actuator 363 is operated so as to reduce the projecting amount of the rod 363*b* against the biasing force of the spring 363*c*. As a result, the front end of the rod 363*b* is separated from the second thermal head 361, and further separated from also the paper feed path 322. Therefore, when the printing is executed only on the first face P1 of the thermal recording paper P, the second thermal head 361 does not contact with the thermal recording paper P and is not abraded.

Similarly, when the printing is executed only on the second face P2 of the thermal recording paper P, the first actuator 353 is operated.

The both side printer 310 in this embodiment can execute the printing on both the faces of the thermal recording paper P. When it executes the printing only on one face, the thermal head which does not execute the printing is separated from the thermal recording paper P, thereby preventing the abrasion due to sliding between the thermal head and the thermal recording paper P. The loads to be applied to the feed mechanism 323, the gear mechanism 342 and the driving motor 341 can be reduced, thereby improving reliability of the apparatus.

Fourth Embodiment

Figure 11:
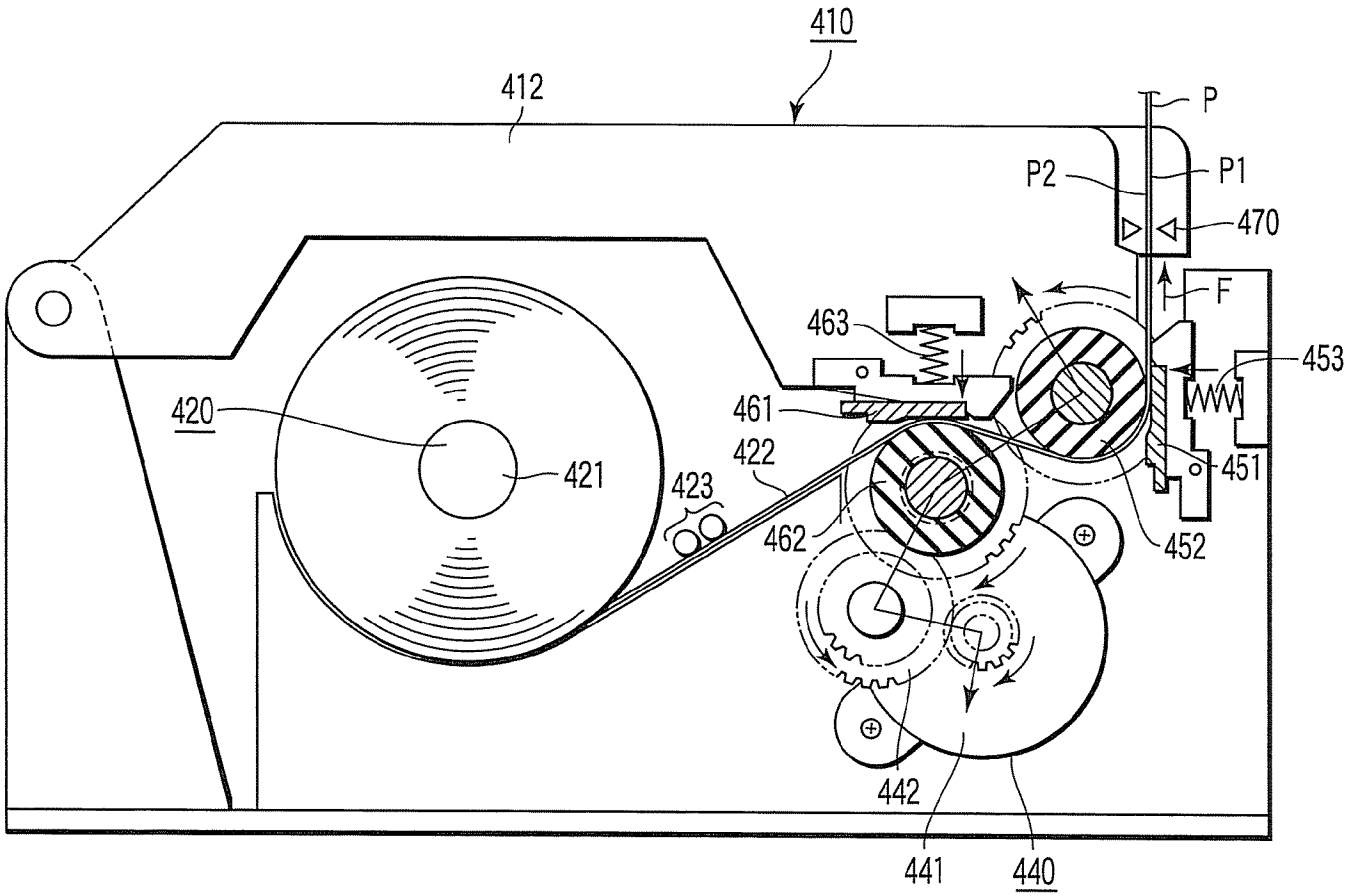
FIG. 11 is a vertical sectional view schematically illustrating a thermal printer according to a fourth embodiment of the present invention.
Figure 12:
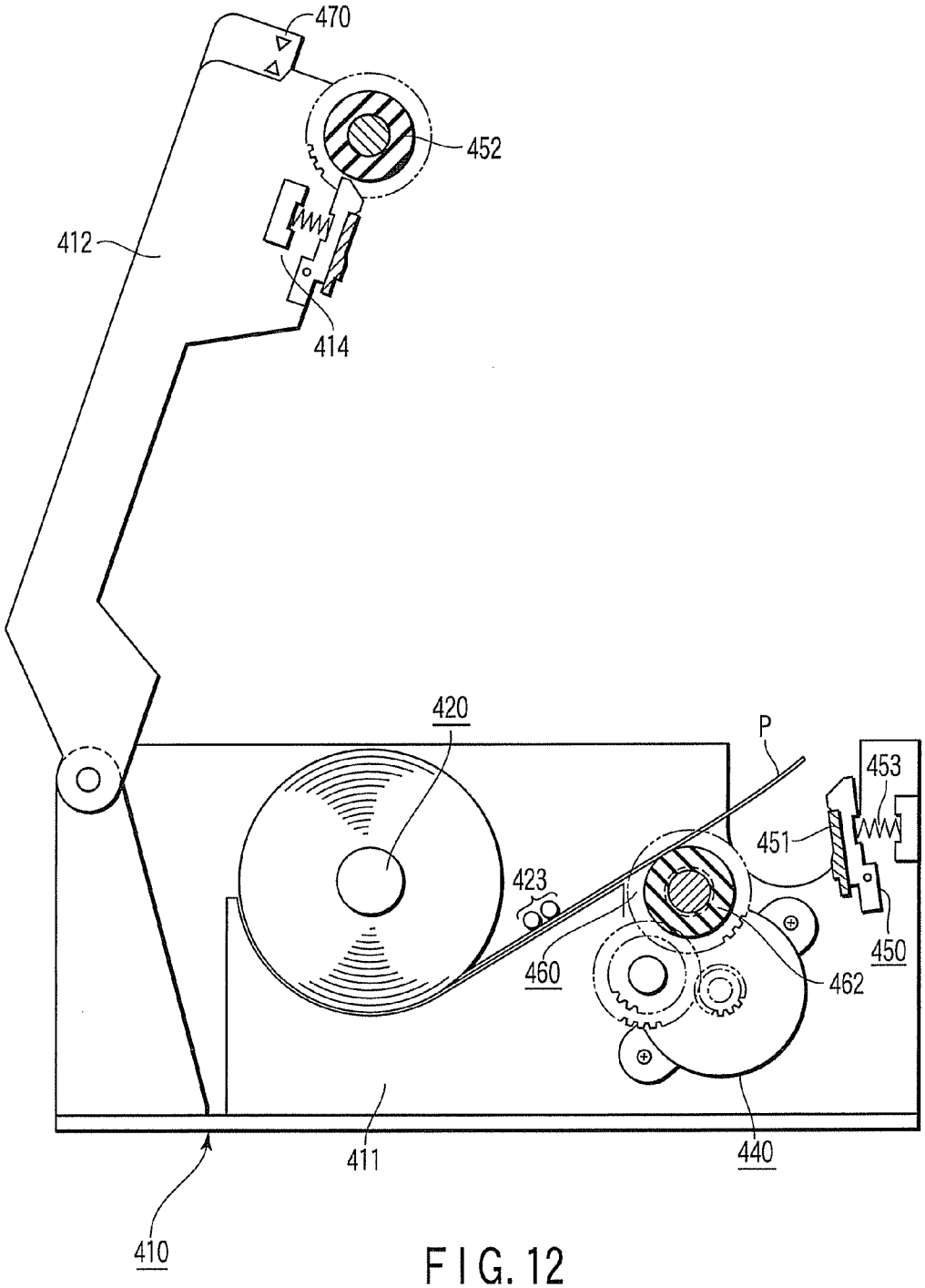
FIG. 12 is a vertical sectional view schematically illustrating a state that an open/close cover of the thermal printer is opened.
Figure 13:
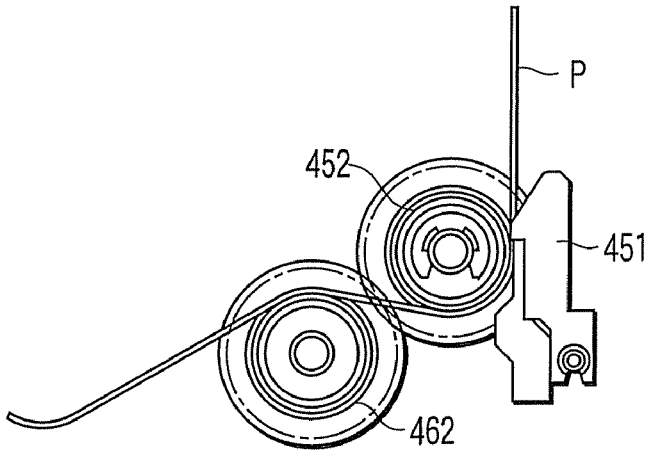
FIG. 13 is a side view illustrating a main section at the time of one side printing of the thermal printer.
Figure 14:
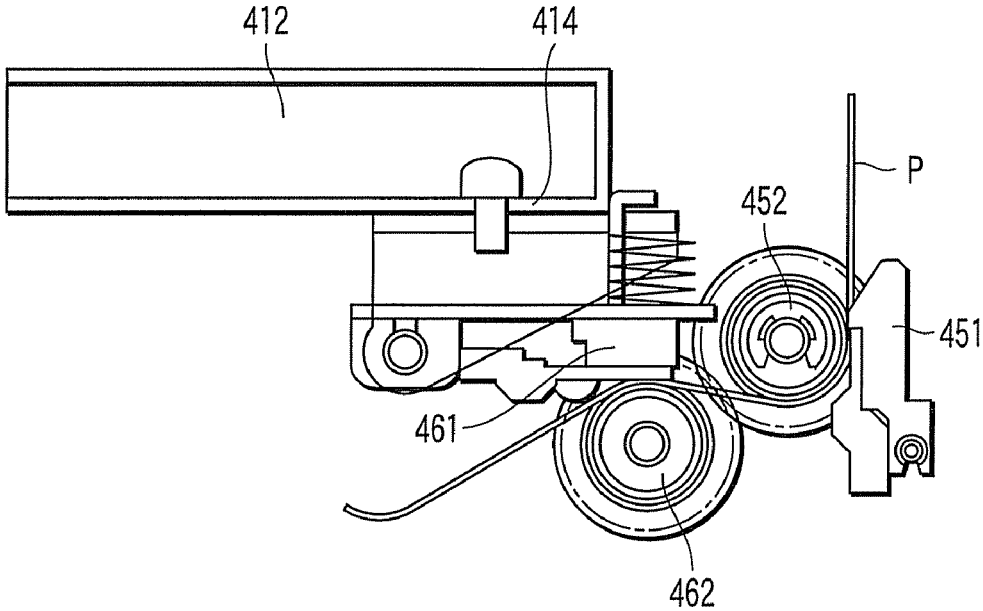
FIG. 14 is a side view illustrating a main section at the time of both sides printing of the thermal printer.

FIG. 11 is a vertical sectional view schematically illustrating a thermal printer 410 according to a fourth embodiment of the present invention, and FIG. 12 is a vertical sectional view schematically illustrating a state that an open/close cover 412 of the thermal printer 410 is opened. FIGS. 13 and 14 are side views illustrating main sections of a printing mechanism 430 incorporated into the thermal printer 410. P in the drawing designates the thermal recording paper having both printing faces, P1 designates a front face and P2 designates a rear face.

The thermal printer 410 has an enclosure main body 411 which houses respective mechanisms, and the open/close cover 412 which is provided to the enclosure main body 411 so as to be freely opened and closed. A thermal head mounting section 414 is provided onto an inner face of the open/close cover 412.

The enclosure 411 houses a thermal recording paper supply section 420 which supports a thermal recording paper roll R around which the thermal recording paper P is wound and supplies the thermal recording paper P, and a printing mechanism 430 which executes printing on the supplied thermal recording paper P.

The thermal recording paper supply section 420 has a retainer 421 which retains the thermal recording paper roll R, and a feed mechanism 423 which feeds the thermal recording paper P from the retainer 421 to the printing mechanism 430 along a paper feed path 422. F in the drawing designates a feed direction.

The printing mechanism 430 has a driving mechanism 440, a first printing section 450 which is provided along the paper feed path 422, a second printing section 460, and a cutting mechanism 470.

The driving mechanism 440 has a driving motor 441, and a gear mechanism 442 which transmits a rotational force generated by the driving motor 441 to the respective sections.

The first printing section 450 has a first thermal head 451 which is arranged so as to be opposed to one side (front face P1) perpendicular to the projecting direction of the paper feed path 422, a first platen roller 452 which is arranged so as to be opposed to the first thermal head 451 via the paper feed path 422, and a spring 453 which biases the first thermal head 451 towards the first platen roller 452.

The first platen roller 452 is mounted to the open/close cover 412, and the gear mechanism 442 is connected to a driving system of the first platen roller 452 in a state that the open/close cover 412 is closed.

The second printing section 460 has a second thermal head 461 which is arranged on the other end (rear face P2) perpendicular to the projecting direction of the paper feed path 422 in an opposed manner, a second platen roller 462 which is arranged so as to be opposed to the second thermal head 461 via the paper feed path 422, and a spring 463 which biases the second thermal head 461 towards the second platen roller 462. The second platen roller 462 is driven by the gear mechanism 442.

The second thermal head 461 is mounted to a thermal head mounting section 414 of the open/close cover 412 detachably, and is connected to a control section (not shown) housed in the enclosure main body 411 in the state that the open/close cover 412 is closed.

The thermal printer 410 having such a constitution is used as follows. One side printing is firstly explained. Since a user who executes only one side printing does not use the second thermal head 461, the user mounts nothing to the thermal head mounting section 414.

When the open/close cover 412 is closed, the control section is connected to the first thermal head 451. When a printing command is input from the outside, the driving motor 441 rotates in a constant direction. The rotation of the driving motor 441 drives the feed mechanism 423 via the gear mechanism 442, and drives the thermal recording paper P to a feed direction F.

The gear mechanism 442 rotates the first platen roller 452 and the second platen roller 462 to the feed direction of the thermal recording paper P. As a result, the driving forces by means of the first platen roller 452 and the second platen roller 462 act on the thermal recording paper P, and the thermal recording paper P is driven to the feed direction F.

When the thermal recording paper P reaches the first printing section 450, the printing on the front face P1 of the thermal recording paper P starts. When the printing on the thermal recording paper P is completed, the feed mechanism 423 feeds the thermal recording paper P to the cutting mechanism 470 so that the paper P is cut.

The both side printing is explained below. A user who executes the both side printing mounts the second thermal head 461 to the thermal head mounting section 414.

When the open/close cover 412 is closed, the gear mechanism 442 is connected to a driving system of the first platen roller 452, and the control section is connected to the second thermal head 461. When a printing command is input from the outside, the driving motor 441 rotates in a constant direction. The rotation of the driving motor 441 drives the feed mechanism 423 via the gear mechanism 442, and drives the thermal recording paper P to the feed direction F.

The gear mechanism 442 further rotates the first platen roller 452 and the second platen roller 462 to the feed direction of the thermal recording paper P. As a result, driving forces by means of the first platen roller 452 and the second platen roller 462 act on the thermal recording paper P, so as to drive the thermal recording paper P to the feed direction F.

When the thermal recording paper P reaches the second printing section 460, the second printing section 460 starts the printing on the rear face P2 of the thermal recording paper P. When the thermal recording paper P is further fed and reaches the first printing section 450, the printing on the front face P1 of the thermal recording paper P is started.

In such a manner, when the thermal recording paper P reaches the first printing section 450, the printing on the front face P1 of the thermal recording paper P is started. When the printing on the thermal recording paper P is completed, the feed mechanism 423 feeds the thermal recording paper P to the cutting mechanism 470 so that the paper P is cut.

According to the thermal printer 410 in this embodiment, when the second thermal head 461 for the printing on the rear face is detachable, the introduction cost at the time of the one side printing is restrained, and simultaneously upgrade to the both side printing is enabled only by the introduction of the second thermal head 461.

The thermal printer of the present invention is not limited to the embodiments. That is to say, in the embodiments, the roll paper is composed of both sides thermal recording paper, but an ink ribbon, for example, may be used so as to execute the printing on both the faces of the roll paper.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A printing apparatus, comprising:

a main body having a first thermal head capable of printing on a first face of roll paper;

a cover body having a second thermal head capable of printing on a second face opposite to the first face of the roll paper;

a hinge mechanism which retains the cover body so that the cover body can rotationally move between a first state that it covers the main body and a second state that it is opened with respect to the main body;

a first platen roller provided to the cover body so as to correspond to the first thermal head of the main body;

a second platen roller provided to the main body so as to correspond to the second thermal head of the cover body;

a first locating mechanism which locates the first platen roller of the cover body with respect to the first thermal head of the main body when the cover body makes the shift from the second state to the first state, and arranges the second thermal head of the cover body in the vicinity of the second platen roller of the main body; and a second locating mechanism which locates the second thermal head arranged in the vicinity of the second platen roller by the first locating mechanism with respect to the second platen roller of the main body, subsequently with the locating of the first locating mechanism, wherein the cover body comprises:

a first frame which is fixed to the hinge mechanism and supports the second thermal head;

a second frame which supports the first platen roller; and a connector which connects the first frame and the second frame so that the second frame can be rotationally moved with respect to the first frame.

2. The printing apparatus according to claim 1, wherein the first locating mechanism includes a concave section which is provided to the main body so that the first platen roller of the cover body is fitted into the concave section in the first state, the concave section locates the fitted first platen roller with respect to the first thermal head, and determines a horizontal position of the second thermal head with respect to the second platen roller via the locating of the first platen roller.

3. The printing apparatus according to claim 2, wherein the second locating mechanism includes the first platen roller which is fitted into the concave section, the first frame, the second frame and the connector, and rotationally moves the first frame and the second frame about the first platen roller fitted into the concave section so that the connector is made to be close to the main body, so as to locate the second thermal head of the cover body with respect to the second platen roller of the main body.

4. The printing apparatus according to claim 3, wherein the second locating mechanism includes a hook member which is provided to the main body and is hooked on the cover body in the first state, and the hook member determines a vertical position of the second thermal head with respect to the second platen roller.

5. The printing apparatus according to claim 4, wherein the hook member is hooked in the vicinity of the connector of the cover body.

6. The printing apparatus according to claim 5, wherein the hook member is hooked on the first frame of the cover body.

7. The printing apparatus according to claim 2, wherein the concave section has a semicircular shape whose upper portion is opened.

8. The printing apparatus according to claim 1, wherein the second thermal head is detachable from the cover body.

9. A printing apparatus, comprising:

a main body having a first thermal head capable of printing on a first face of roll paper;

a cover body having a second thermal head capable of printing on a second face opposite to the first face of the roll paper;

a hinge mechanism which retains the cover body so that the cover body can rotationally move between a first state that it covers the main body and a second state that it is opened with respect to the main body;

a first platen roller provided to the cover body so as to correspond to the first thermal head of the main body;

a second platen roller provided to the main body so as to correspond to the second thermal head of the cover body;

a first locating mechanism which locates the first platen roller of the cover body with respect to the first thermal head of the main body when the cover body makes the shift from the second state to the first state, and arranges the second thermal head of the cover body in the vicinity of the second platen roller of the main body; and a second locating mechanism which locates the second thermal head arranged in the vicinity of the second platen roller by the first locating mechanism with respect to the second platen roller of the main body, wherein the cover body comprises:

a first frame which is fixed to the hinge mechanism and supports the second thermal head;

a second frame which supports the first platen roller; and a connector which connects the first frame and the second frame so that the second frame can be rotationally moved with respect to the first frame.

* * * * *